United States Patent [19]

Hedge et al.

[11] 4,165,138

[45] Aug. 21, 1979

[54] DISPENSER CABINET FOR SHEET MATERIAL AND TRANSFER MECHANISM

[75] Inventors: Russell K. Hedge, Green Bay; William S. Huss, Appleton, both of Wis.

[73] Assignee: Mosinee Paper Company, Mosinee, Wis.

[21] Appl. No.: 787,791

[22] Filed: Apr. 15, 1977

Related U.S. Application Data

[63] Continuation-in-part of Ser. No. 741,947, Nov. 15, 1976, abandoned.

[51] Int. Cl.[2] ..... B65H 19/06

[52] U.S. Cl. ..... 312/39; 312/38; 242/55.3; 242/55.53; 242/58

[58] Field of Search ..... 312/37, 38, 39; 242/55.3, 55.53

[56] References Cited

U.S. PATENT DOCUMENTS

| | | | |
|---|---|---|---|
| 2,839,345 | 6/1958 | Engel et al. | 312/38 |
| 3,007,650 | 11/1961 | Burton | 242/55.3 |
| 3,606,306 | 9/1971 | Brown, Jr. et al. | 271/31 |
| 3,650,487 | 3/1972 | Bahnsen | 242/55.3 |
| 3,653,733 | 4/1972 | Wyant | 312/39 |
| 3,700,181 | 10/1972 | Diring et al. | 312/39 |
| 3,771,739 | 11/1973 | Nelson | 312/39 |

*Primary Examiner*—Casmir A. Nunberg
*Attorney, Agent, or Firm*—Gary, Juettner & Pyle

[57] ABSTRACT

A dispenser for sheet material having stations for primary and reserve rolls of the material is characterized by improved mechanisms for transferring feed of the sheet material from the primary roll to the reserve roll upon complete exhaustion of the primary roll.

In the disclosed embodiments the dispenser is a roll paper towel dispensing cabinet, and a feed mechanism initially receives and delivers paper from the primary roll to the exterior of the cabinet. The transfer mechanism senses the presence of the primary roll web at the feed mechanism and, irrespective of the tension of the web between the feed mechanism and the roll, automatically transfers the beginning of the web of the reserve roll to the feed mechanism only upon movement of the very end of the primary roll web past the feed mechanism.

As a consequence of the transfer mechanism operating only in response to passage of the end of the primary roll web past the feed mechanism, absolutely no paper is wasted by the transfer process, and there can be no "false" transferring of rolls resulting from variations in the tension of the web.

25 Claims, 10 Drawing Figures

3
20
38
40
R
40
42
78
22
72
44
62
66
60
86
84
114
100
86
116
94
98
90
98
70
74
96
128
64
30
28
3

20
40
78
76
78
80
88
86
72
84
86
80
82
62
66
60
68
114
100
68
88
116
70
92
98
90
74
98
94
92
152
96
64
30
28

26
R
38
40
44
24
20
78
76
82
101
72
74
98
86
80
94
62
82
99
96
36
54
52
60
P
50
56
32
30
48
58
46
34

DISPENSER CABINET FOR SHEET MATERIAL AND TRANSFER MECHANISM

CROSS REFERENCE OF RELATED CASE

This application is a continuation-in-part application of copending application Ser. No. 741,947, filed Nov. 15, 1976, now abandoned.

BACKGROUND OF THE INVENTION

The present invention relates to dispensers for sheet material, and in particular to paper towel roll dispensing cabinets having improved roll transfer mechanisms which sequentially dispense paper from first and second rolls thereof.

Dispensing cabinets have been designed to dispense two rolls of sheet material sequentially, so that upon depletion of the material from one of the rolls, the unwinding of the other roll is commenced. Some such dispensers involve a modification of the sheet material itself, such as an aperture formed in the material near the tail end thereof. The modification to the material is detected as the material on the roll nears or reaches exhaustion, and the mechanism accomplishing detection then operates some transfer means for commencing the dispensing of sheet material from the second roll.

Sheet materials are normally manufactured in a standard form so that they can be dispensed from any one of various types of cabinets. However, the cabinets as described inherently prevent the dispensing of such normal or unmodified rolls of sheet material, and the rolls must first be modified, at increased cost, to accommodate the detecting mechanism of the cabinet.

To avoid the additional cost of modifying the rolls of material, some recent dispensers use unmodified rolls and detect the tension of the material between the first roll thereof and a feed mechanism for delivering the material from the cabinet, and effect a transfer of material from the second roll to the feed mechanism upon a loss in the tension of the material from the first roll. Ideally, the tension of the first roll material is lost only when the tail end of the material leaves the core of the roll upon depletion of the roll. Unfortunately, however, in the normal use of such cabinets the tension is occasionally lost, at least momentarily, due to causes other than depletion of the roll. For example, a bind occurring in the rotation of the roll may, upon being overcome, cause the roll to jump and provide slack, or release the tension, in the material between the roll and the feed mechanism. As the cabinet cannot distinguish the particular cause of the tension loss, this may result in a "false" transfer of material from the second roll to the feed mechanism, which ordinarily either jams the mechanism, whereupon no material is delivered from the cabinet, or causes the mechanism to simultaneously deliver material from both of the rolls, which wastes and rapidly exhausts the entire supply of material.

OBJECTS OF THE INVENTION

A principal object of the present invention is to provide dispensing cabinets having an improved transfer mechanisms for effecting sequential dispensing of sheet material from first and second rolls thereof in a reliable manner.

Another object of the present invention is to provide transfer mechanisms in dispensing cabinets for automatically commencing the feeding of sheet material from a second roll only upon depletion of sheet material from a first roll.

SUMMARY OF THE INVENTION

In accordance with the present invention, a towel dispenser having a feed mechanism for withdrawing and dispensing toweling from rolls thereof includes a transfer mechanism which automatically transfers feed of toweling from a primary to from a secondary roll only upon sensing the absence of the toweling from the primary roll at the feed mechanism, irrespective of the tension of the toweling between the primary roll and the feed mechanism.

In preferred embodiments, the feed mechanism comprises a pair of feed rolls, and the toweling is initially withdrawn from the primary roll around one of the feed rolls and through a nip therebetween. The leading end of the reserve roll is positioned between the feed rolls and a transfer mechanism, and the transfer mechanism is responsive to movement of the end of the primary roll toweling from around the one feed roll to introduce the leading end of the reserve roll toweling into the nip between the rolls, whereupon feeding of toweling from the reserve roll is commenced.

As a consequence of the transfer mechanism being responsive only to movement of the end of the primary roll toweling from around the first roll, to cause feed of the reserve roll toweling to begin, there can be no false transfer of feed resulting from naturally occurring variations in primary toweling tension, as with most conventional devices, and there is no waste of toweling from the primary roll.

The foregoing and other objects, advantages and features of the invention will become apparent from the following detailed description, when taken in conjunction with the appended drawings.

DETAILED DESCRIPTION

Figure 1:
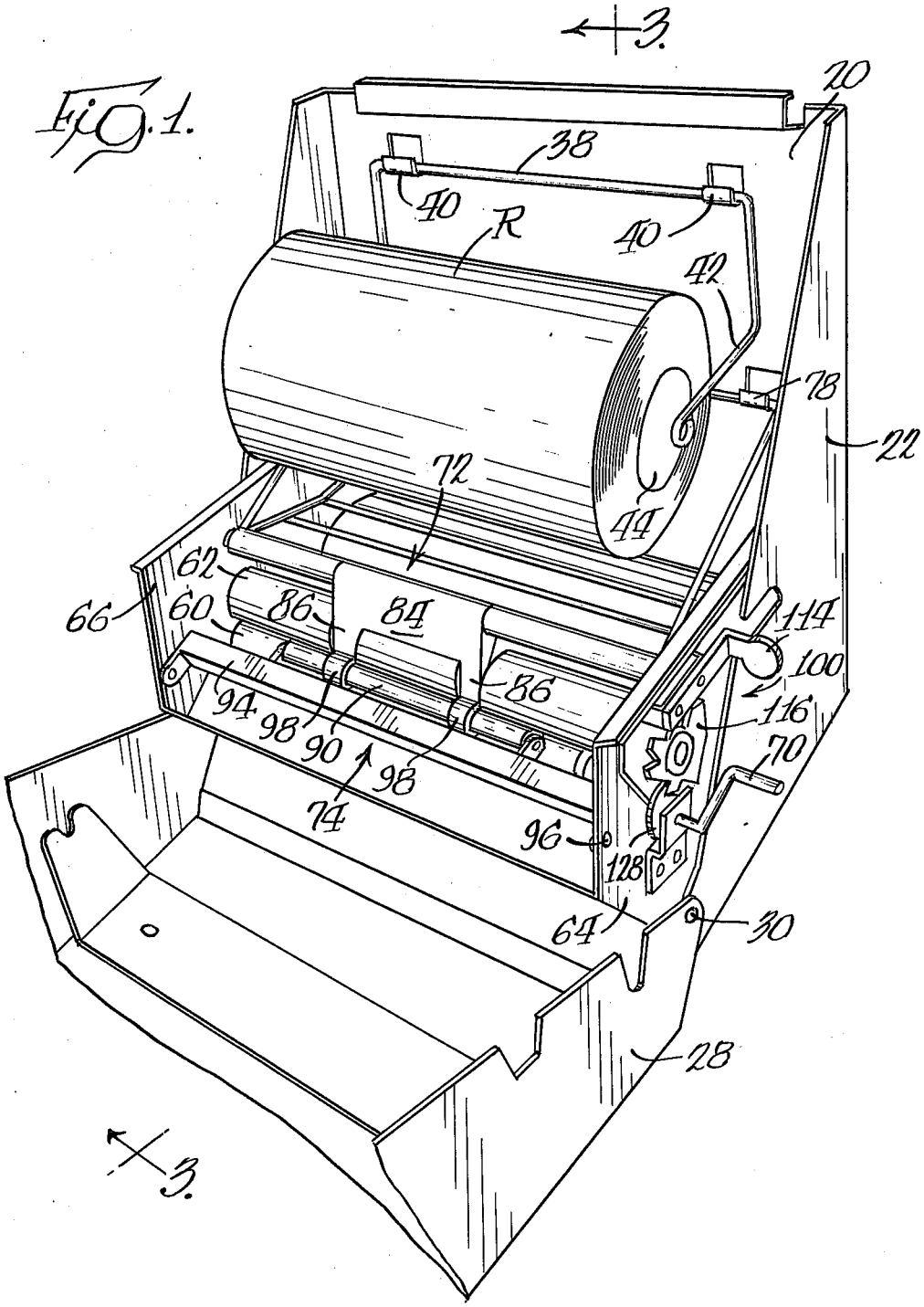
FIG. 1 is a perspective view of a dispensing cabinet having a towel transfer mechanism configured in accordance with one embodiment of the invention, showing the transfer mechanism in a position for feed of toweling from a reserve roll thereof.
Figure 2:
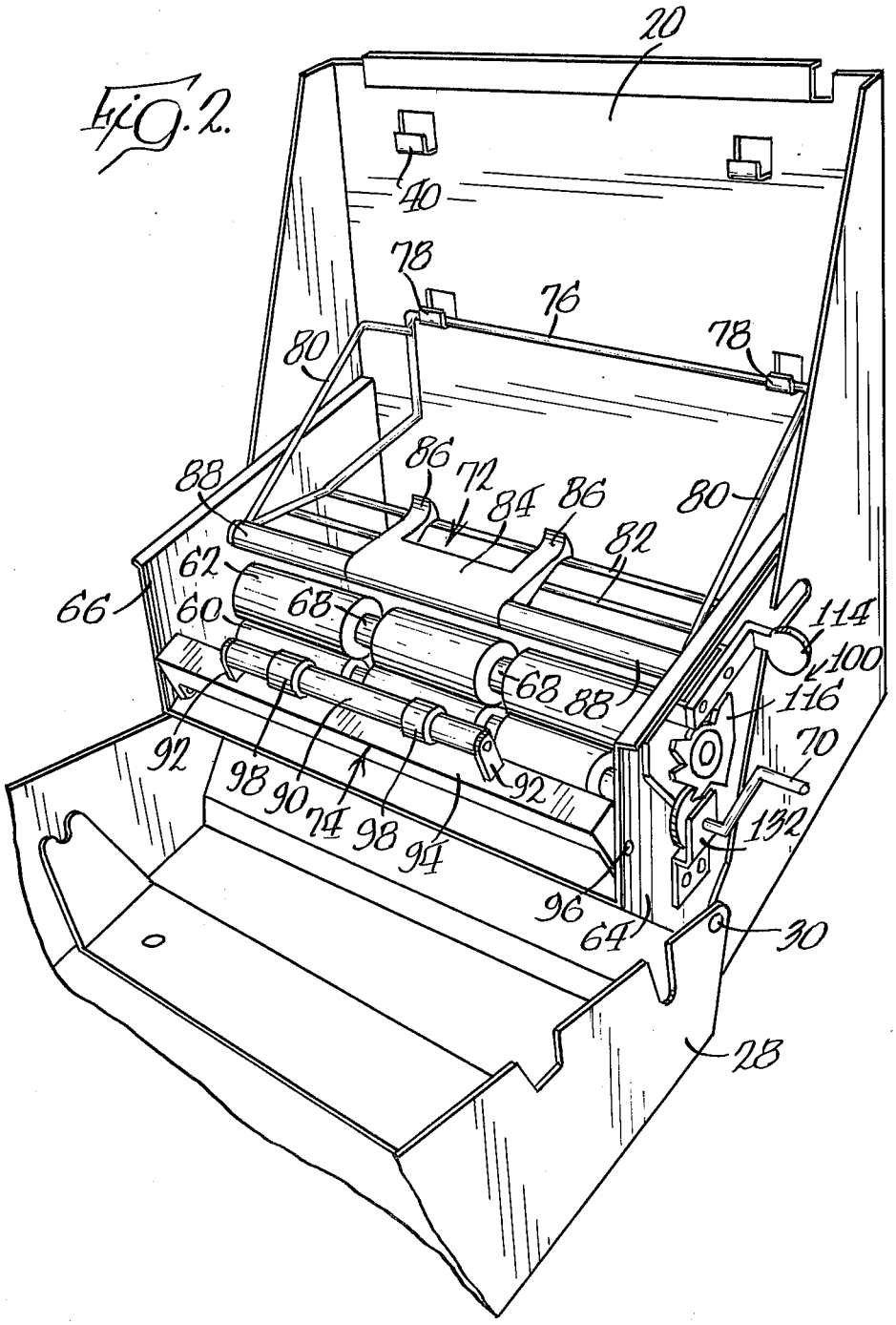
FIG. 2 is a perspective view similar to FIG. 1, and illustrates the transfer mechanism in a position for threading of toweling from a primary roll thereof through a pair of feed rolls.
Figure 3:
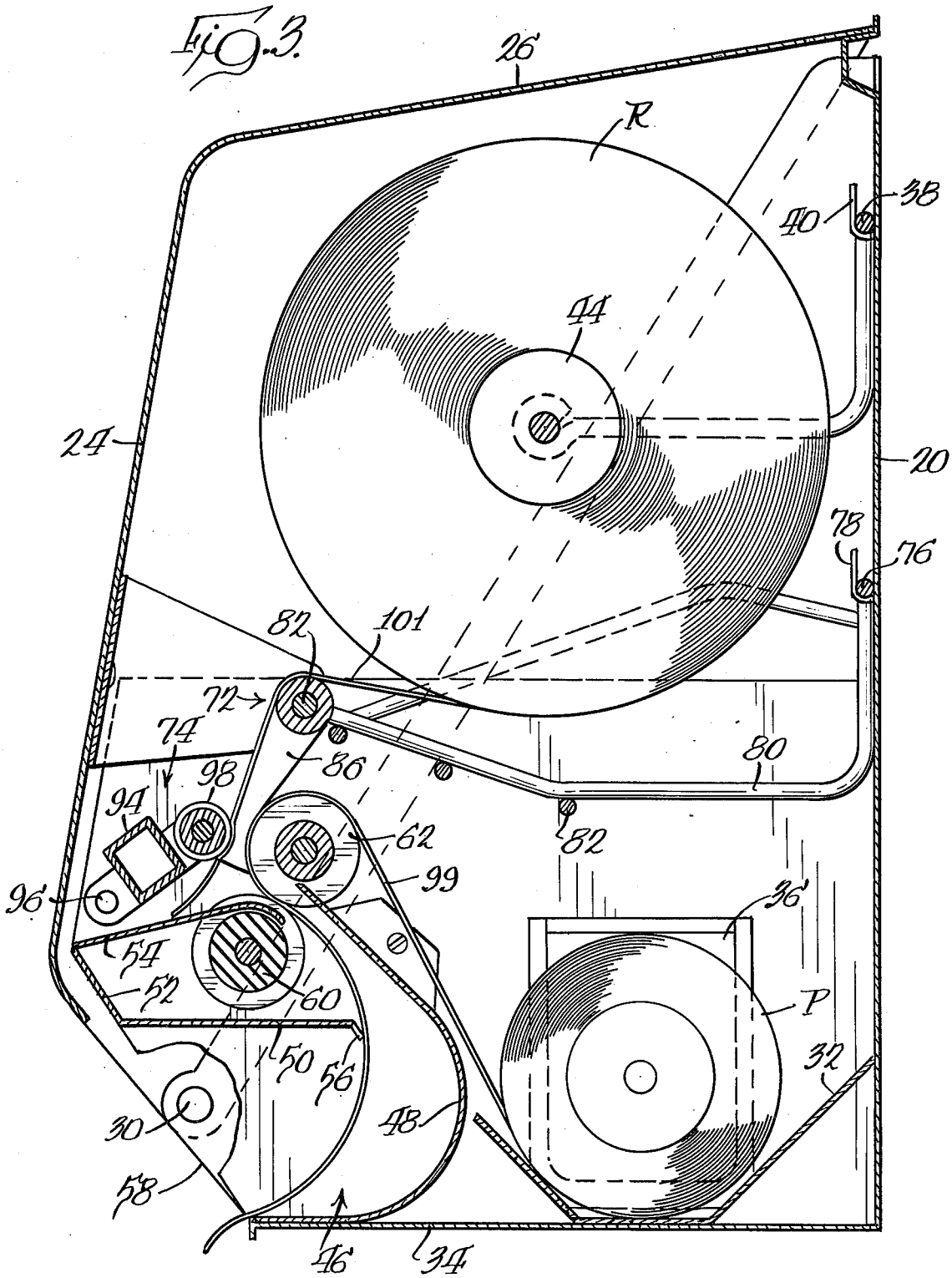
FIG. 3 is a cross-sectional elevation view of the cabinet taken substantially along the lines 3—3 of FIG. 2, showing primary and reserve rolls of toweling in the cabinet with toweling from the primary roll being delivered therefrom, and also showing the transfer mechanism positioned to transfer feed of toweling from the primary roll to from the reserve roll upon exhaustion of the primary roll.

Referring to FIGS. 1-3 of the drawings, a dispensing cabinet having an improved towel transfer mechanism in accordance with one embodiment of the invention is provided with a back wall 20, which usually is fastened to a support in the mounting of the dispenser, side walls 22, and a cover including a front wall 24, a top wall 26 and side walls 28. The cover is pivotally connected to the remaining cabinet structure by means of pivot pins 30,30, so that it may be swung either downwardly to fully expose the interior of the cabinet, or upwardly to close the cabinet. The cabinet is provided with stations for accommodating primary P and reserve R rolls of paper toweling, the primary roll being that roll which is supplying the paper toweling and the reserve roll being that roll which is in reserve for subsequent dispensing of the toweling.

Referring particularly to FIG. 3, the station for a primary roll of toweling is provided in the cabinet by a wall member 32 having a lower portion contiguous with a base 34 of the cabinet, and upwardly inclined side portions defining a recess therewithin for receiving the primary roll. The longitudinal position of the primary roll is established by a pair of flanges 36 fastened to the side walls of the cabinet and extending inwardly thereof to adjacent opposite ends of the primary roll. The station for a reserve roll of toweling is established by a bent wire element 38 rotatably supported on the back wall 20 by hanger clips 40 formed integrally with the wall. The wire element includes a pair of forwardly extending arms 42 carrying at the ends thereof roll mounting elements 44 configured to be received within the ends of the roll core of the reserve paper roll, by means of which the reserve roll may rotatably be mounted within the cabinet. Mounting of the reserve roll within the cabinet or removal therefrom is accomplished merely by outward flexing of the arms 42.

The channel or passage through which toweling is delivered from the cabinet is indicated generally at 46, and is formed between a curvilinear wall 48 and a lower wall 50 of a quasi U-shaped wall member, the member further including a base portion 52 and an upper wall 54. An edge 56 of the wall 50 is formed with paper cutting serrations or teeth, whereby paper delivered from the cabinet through an opening 58 in the lower forward edge of the cover may be severed by pulling.

The paper feed mechanism for delivering or dispensing paper toweling from the cabinet includes a drive roll 60 and a pressure or idler roll 62 longitudinally journaled in and between a pair of side walls 64 and 66 in the cabinet. The drive roll has rubber rings or other suitable friction material thereon for cooperating with the pressure roll in the feed of the paper in a manner which is well known and understood in the art. The idler roll may be of any suitable material, such as wood, and has a pair of annular recesses 68 formed concentrically therewith for cooperating with a feed transfer mechanism in the transfer of feed of toweling from the primary roll to from the reserve roll, as will be described. The drive roll is provided with an operating handle or crank 70 extended through the adjacent side wall of the cabinet, whereby the drive roll may manually be rotated to deliver toweling from the cabinet. As is customary, a one way clutch (not shown) links the crank with the drive roll for rotation of the roll only in a direction for dispensing toweling from the cabinet, whereby reverse feeding of toweling into the cabinet is prevented.

Referring particularly to FIGS. 1 and 2, the transfer mechanism for transferring feed of the rolls from the primary to from the reserve roll includes a towel sensing means, indicated generally at 72, and a towel transfer means, indicated generally at 74. The towel sensing means is mounted on a wire element having a longitudinal section 76 rotatably received within a pair of hinge clips 78 formed integral with the back wall of the cabinet, a pair of side arm sections 80 and a plurality of longitudinally extending front sections 82, and includes a body portion 84 having a pair of towel sensing fingers or web feelers 86 extending therefrom. The body portion is rotatably mounted on a forwardmost longitudinal section 82, and is spaced from the side arm sections 80 by a pair of rotatably mounted spacers 88. The length and spacing of the sensing fingers 86, and the positioning of the sensing means, are such that upon forward rotation of the sensing means the fingers 86 enter the idler roll slots 68 as shown in FIG. 1, the slots being of sufficient depth to receive the fingers therein beyond the outer surface of the roll. While the sensing means is rotated rearwardly as shown in FIG. 2, the fingers are supported by the rearward wire sections 82 which prevent complete rearward rotation thereof.

The transfer means 74 includes a transfer roll 90 rotatably supported along its longitudinal axis between a pair of posts 92 on a support 94, the support in turn being rotatably connected with and between the side walls 64 and 66 by pivot pins 96. The transfer roll is movable with the support between a position away from the feed mechanism, as shown in FIG. 2, to a position immediately adjacent the feed mechanism, as shown in FIG. 1, whereat the roll is longitudinally aligned with and very closely adjacent the nip between the drive and idler rolls. The transfer roll has a pair of transfer rings 98, aligned with the sensing fingers 86, for entering the slots 68 when the roll is moved to adjacent the feed mechanism.

With the cabinet in the condition illustrated in FIG. 3, a webbing 99 from the primary roll P extends in a run around the idler roll 62 and through the nip between the feed rolls 60 and 62 for being delivered exterior of the cabinet, and the forward end of a webbing 101 from the reserve roll R is positioned between the towel sensing means 72 and the towel transfer means 74 for automatically being introduced into the feed mechanism upon exhaustion of the primary roll. To obtain this condition with an initially empty cabinet, the bent wire element 38 and the towel sensing means 72 are rotated upward and rearward about the hinge clips 40 and 78, and the towel transfer means 74 is moved to its position away from the feed rolls. This opens the primary roll station within the cabinet, so that a roll of toweling may be positioned therein and the forward end of the web thereof extended around the pressure roll 62, through the nip between the feed rolls, and through the delivery channel 46 to exterior of the cabinet. The wire element supporting the sensing means 72 is then moved to its forward and downward position, and the sensing means is rotated forwardly thereabout to rest the fingers 86 against the web 99 from the primary roll, which web now covers the idler roll slots 68 and precludes entry of the web sensing fingers therein. The reserve roll R is then rotatably mounted on the roll mounting elements 44, and the leading end of its web 101 is positioned across curved upper surfaces of the sensing means body portion 84 and the spacers 88, along the surface of the sensing fingers 86 and to the wall 54. The towel transfer means 74 is then moved rearward to rest the transfer rings 98 against the reserve roll web with the web between the transfer rings and the sensing fingers. In this condition, the primary roll web over the idler roll slots blocks the sensing fingers from entering the slots and the sensing fingers in turn block the transfer roll from moving to adjacent the nip between the feed rolls. Toweling from the primary roll may now be delivered from the cabinet by operation of the crank 70, with the webbing freely sliding over and moving past the sensing fingers 86.

Figure 4:
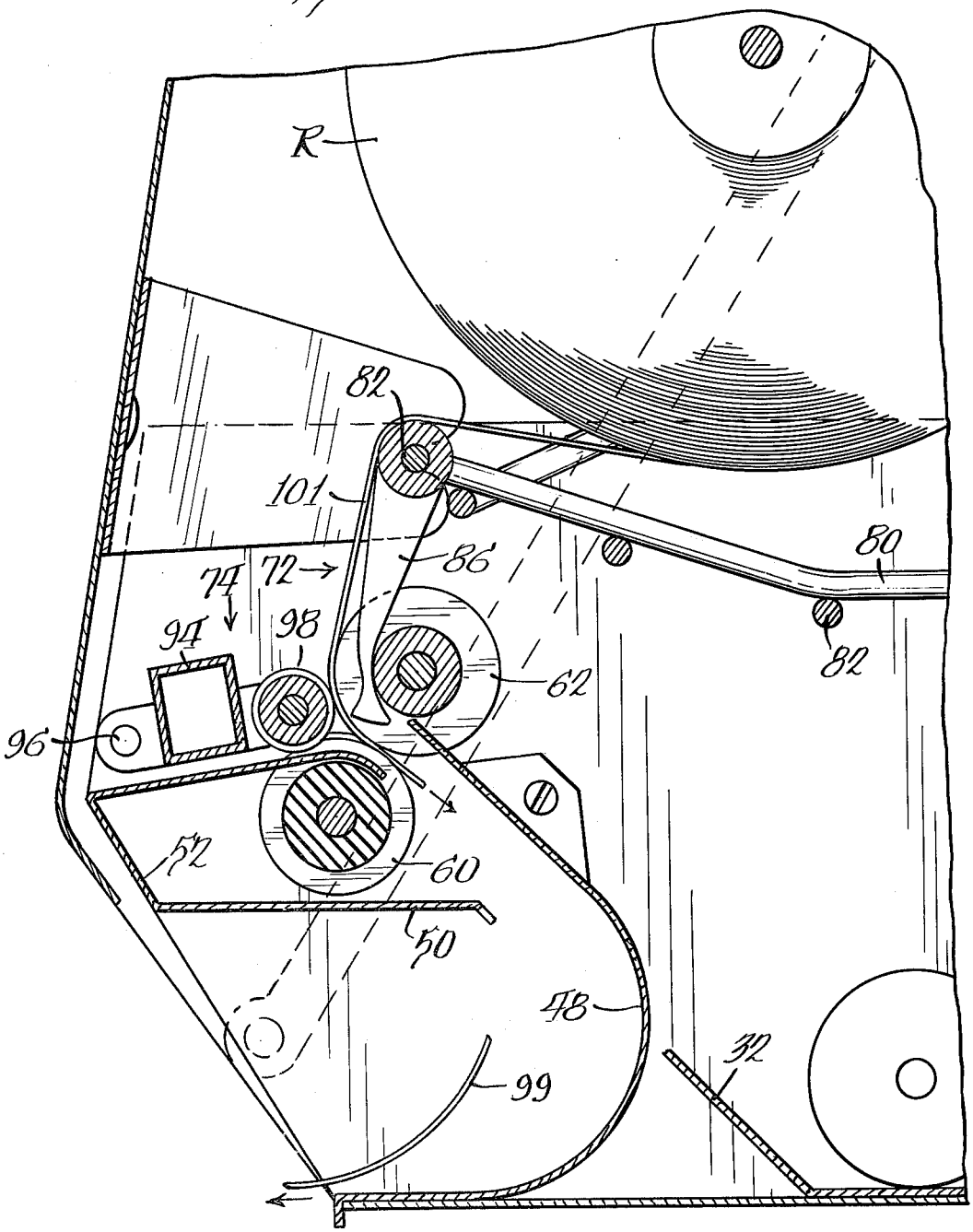
FIG. 4 is a partial cross-sectional elevation view similar to FIG. 3, and illustrates the transfer mechanism transferring feed of toweling to from the reserve roll upon depletion of the primary roll.

The condition of the cabinet remains as shown in FIG. 3 until the primary roll is completely depleted and the end of the web 99 moves from around the surface of the idler roll 62. When this occurs, or upon the absence of the web 99 from around the roll 62, as shown in FIG. 4, the sensing fingers 86 are freed to move into the slots in the roll. This frees the transfer roll of the towel transfer means 74 to move, by gravity or under the urging of a spring (not shown), toward and between the feed rolls to deliver the forward end of the reserve roll web 101 to a position adjacent the nip between the rolls and to cause the webbing to be introduced therein. In consequence, paper feed now occurs by withdrawing the web from the reserve roll. This condition then continues until either the reserve roll is exhausted and the cabinet is loaded with fresh primary and reserve rolls, or until the cabinet is otherwise serviced as by moving the partially used reserve roll to occupy the primary roll station and introducing a fresh reserve roll into the reserve roll station in the cabinet. Thus transfer of feed from the primary to from the secondary roll occurs only upon exhaustion of the primary roll, and is independent of the tension of the web 99 between the primary roll and the feed rolls. It is understood that the empty cores of the rolls are removed from the cabinet prior to introducing fresh rolls therein, and that should the web from the primary roll be broken prior to depletion of the roll, the transfer mechanism will automatically begin feeding the web from the reserve roll.

Figure 5:
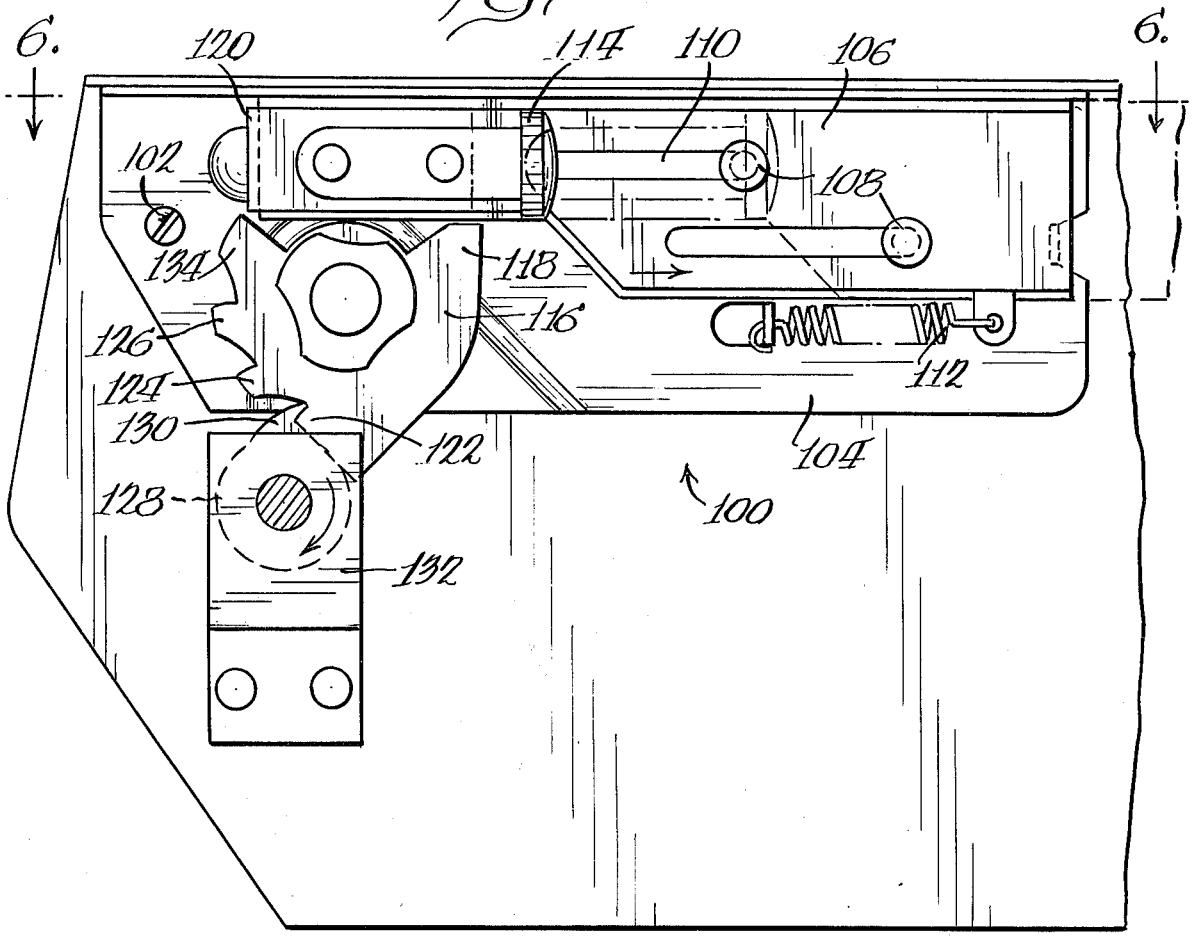
FIG. 5 illustrates a towel length dispensing control for the cabinet.
Figure 6:
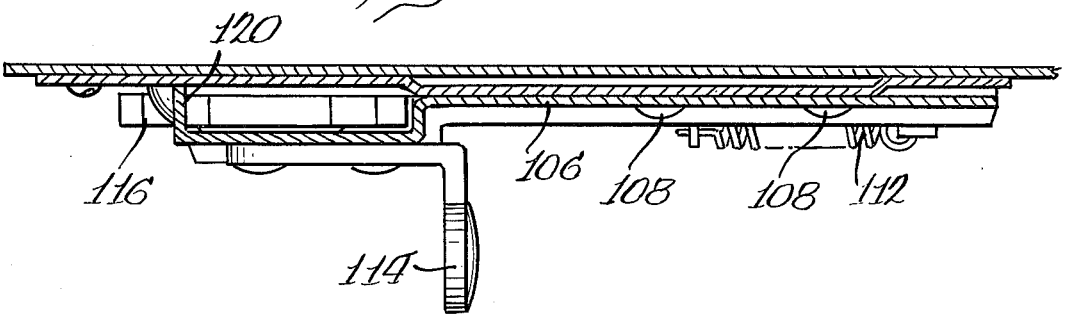
FIG. 6 is a top view of the towel length dispensing control, taken substantially along the lines 6—6 of FIG. 5.

The dispenser preferably includes, as shown in FIGS. 1 and 2 and more particularly in FIGS. 5 and 6, a resettable indexing mechanism 100 which provides for the dispensing of predetermined convenient lengths of toweling from the cabinet, whereby to minimize waste of the toweling. The mechanism is detachably mounted on the side wall 64 of the cabinet by a screw 102, and includes a support bracket 104 having a plate 106 slidably mounted thereon by a pair of pins 108 extended through associated slots 110 in the plate. A spring 112 fastened between the bracket and the plate normally urges the plate toward the front of the cabinet, and a hand operable lever 114 is provided on the plate, whereby the plate may manually be moved toward the rear of the cabinet with respect to the bracket, against the urging of the spring 112, by an amount determined by the length of the slots 110. The bracket 104 also has rotatably mounted thereon a peculiarly shaped multitoothed cam element 116 having a tooth 118 engagable with an inwardly extending lip 120 of the plate 106, whereby movement of the plate toward the rear of the cabinet engages the lip with the tooth to rotate the cam clockwise to the position as shown in FIG. 5. The cam 116 also has a plurality of teeth 122, 124 and 126, the function of which will hereinafter be described.

A pinion 128 having a single tooth 130 is secured to the crank between the side wall 64 and a crank support bracket 132, whereby rotation of the crank, and therethrough rotation of the drive roll 60, is constrained to rotation of the pinion. With the cam 116 in the position shown, the pinion is free to rotate with the crank, and with each revolution the pinion tooth 130 meshes with successive cam teeth 122, 124 and 126 to rotationally index the cam in the counterclockwise direction. For the arrangement shown, after three revolutions of the pinion, and therefore of the drive roll, the cam is indexed to the point where the tooth 118 engages the lip 120 to prevent further rotation thereof, and to where a tooth 134 of the cam is positioned to blockingly engage the pinion tooth 130. Upon engagement of the pinion tooth with the cam tooth 134, continued rotation of the pinion, and therefore of the drive roll, is blocked. Thus the length of the toweling dispensed is determined by the number of revolutions made by the pinion to move the cam from its reset to its blocking position, and to deliver an additional length of toweling from the cabinet the plate 106 must again be moved to the right to rotationally reset the cam. Should such towel length indexing not be desired, the single mounting screw 102 facilitates convenient removal of the indexing mechanism 100 from the cabinet, whereupon the crank 70 may continuously be operated to dispense any desired length of toweling.

Figure 7:
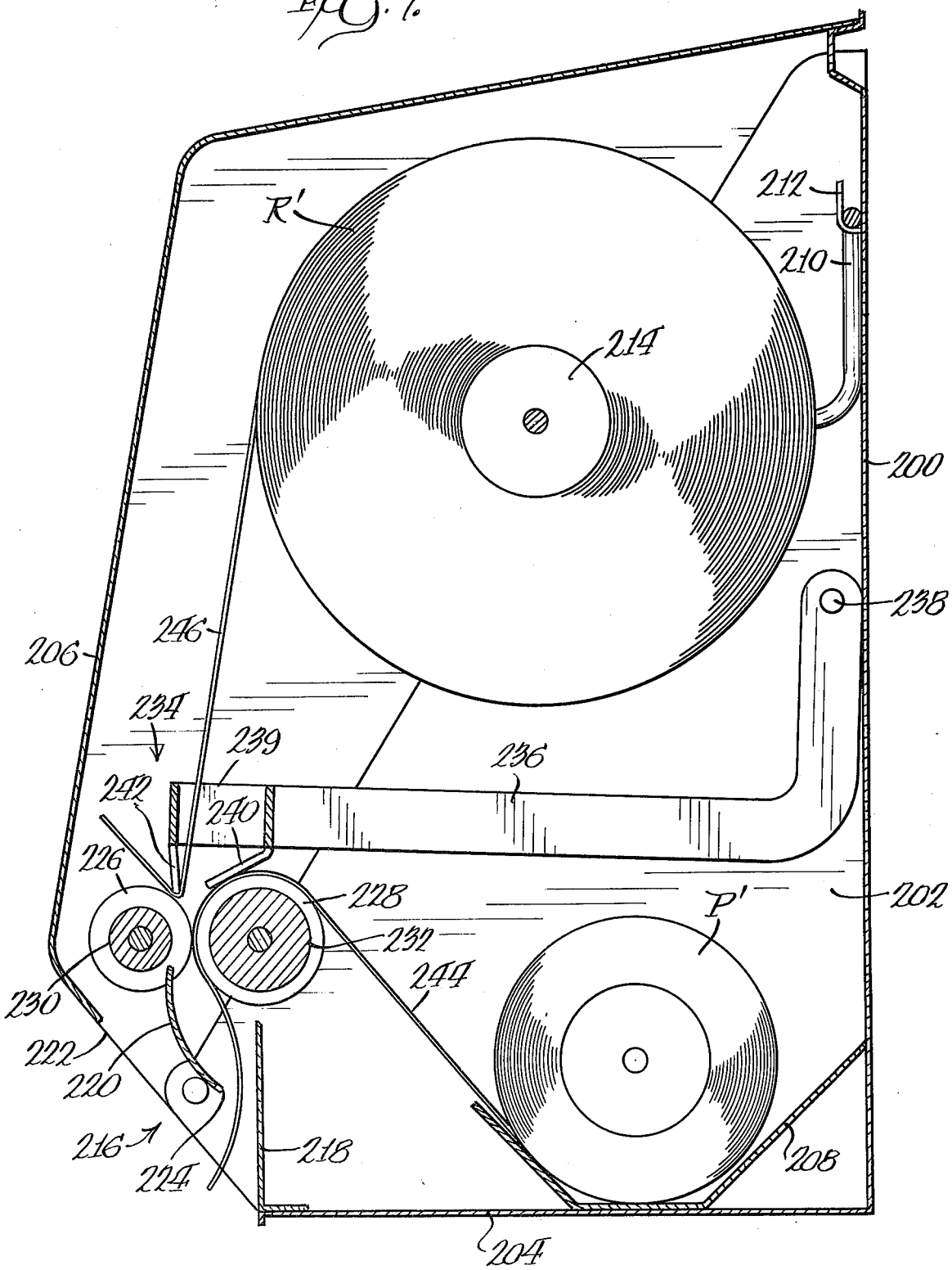
FIG. 7 is a cross-sectional elevation view of a dispensing cabinet having a towel transfer mechanism configured in accordance with another embodiment of the invention, showing primary and reserve rolls of toweling in the cabinet with toweling from the primary roll being delivered therefrom, and showing the transfer mechanism positioned to transfer feed of toweling from the primary roll to form the reserve roll upon exhaustion of the primary roll.
Figure 8:
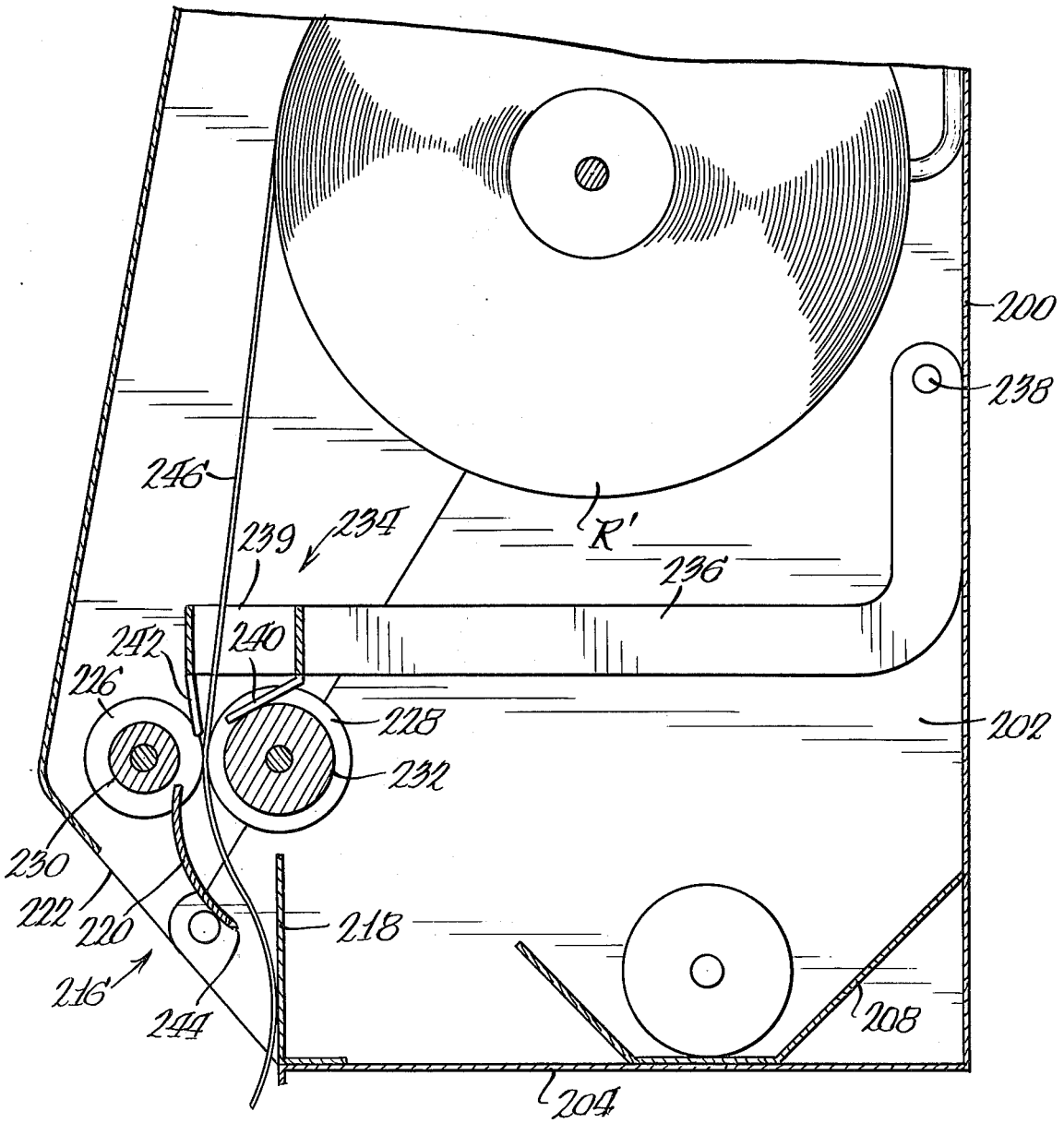
FIG.8 is a partial cross-sectional elevation view similar to FIG. 7, and illustrates the transfer mechanism transferring feed of the toweling to from the reserve roll upon depletion of the primary roll.

Referring to FIGS. 7 and 8 of the drawings, there is shown a dispensing cabinet having a transfer mechanism in accordance with another embodiment of the invention. Similar to the dispensing cabinet of FIGS. 1–4, the cabinet is provided with a back wall 200, side walls 202, a base wall 204 and a cover 206 pivotally mounted to the remaining cabinet structure for movement between positions either closing or exposing the interior of the cabinet. The cabinet also has stations for accommodating primary P′ and reserve R′ rolls of paper toweling, the primary roll station being provided in a lower portion of the cabinet by a wall member 208. The reserve roll station is established in an upper portion of the cabinet by a bent wire element 210 rotatably supported on the back wall by hanger clips 212, and having roll mounting elements 214 configured to be received within and rotatably support opposite ends of the roll core of the reserve paper roll.

The channel or passage through which toweling is delivered from the cabinet is indicated generally at 216, and is provided between an upright wall 218 and a curved wall member 220, and through an opening 222 in the lower forward edge of the cover. A lower edge 224 of the wall 220 is formed with paper cutting serrations or teeth, whereby paper delivered from the cabinet through the opening 222 may be severed by pulling.

The paper feed mechanism for delivering or dispensing toweling from the cabinet includes a pressure or idler roll 226 and a drive roll 228 journaled in and between side walls of the cabinet. The rolls are longitudinally juxtaposed to define a nip therebetween, the drive roll has rubber or other suitable friction material thereon for cooperating with the pressure roll in the feed of paper, and the pressure roll may be of any suitable material, such as wood. The pressure roll has a plurality of spaced annular recesses 230 formed therealong in the surface thereof concentrically therewith, and the drive roll has a like number of spaced annular recesses 232 formed therealong concentrically therewith and aligned with the recesses 230 of the pressure roll, only one annular recess on each roll being shown. The annular recesses cooperate with a feed transfer mechanism in the transfer of feed of toweling from the primary roll to from the reserve roll, as will be described. The drive roll is provided with an operating handle and a one way clutch (neither shown), whereby the roll may be manually rotated only in a direction for dispensing toweling from the cabinet.

The transfer mechanism for transferring feed of toweling from the primary roll to from the reserve roll is comprised of a generally unitary structure, indicated generally at 234, secured to the outer end of a bent bracket 236. The inner end of the bracket is connected with the rear wall 200 by pivot pins 238, the inner bent leg of the bracket permitting the transfer mechanism to move around the reserve roll with upward and rearward rotation of the bracket. The transfer mechanism includes a housing or frame 239 having longitudinally therealong a plurality of downwardly and forwardly extending towel sensing fingers, elements or web feelers 240, and a like number of downwardly and slightly rearwardly extending towel transfer fingers or elements 242, only one sensing finger and one transfer finger of each plurality being shown. The sensing fingers and the transfer fingers are each equal in number to the number of annular recesses on each roll, and have a width and a spacing so that upon downward rotation of the bracket 236 the sensing fingers 240 enter associated annular recesses 232 and rest on lowermost surfaces thereof, and the transfer fingers enter associated annular recesses 230 and have the lowermost ends thereof positioned closely adjacent the nip between the rolls.

With the cabinet in the condition illustrated in FIG. 7, a webbing 244 from the primary roll extends in a run around the drive roll 228 and through the nip between the feed rolls 226 and 228 for being delivered exterior of the cabinet, and the forward end of a webbing 246 from the reverse roll is extended between the transfer and the sensing fingers and forwardly around the ends of the transfer fingers for automatically being introduced into the feed mechanism upon exhaustion of the primary roll. To obtain this condition with an initially empty cabinet, the bracket 236 is rotated rearwardly and upwardly. This opens the primary roll station within the cabinet, so that a roll of toweling may be positioned therein and the forward end of the web thereof extended around the drive roll 228, through the nip between the feed rolls, and through the delivery channel 216 to exterior of the cabinet. The bracket 236 is then rotated forwardly and downward to rest the web sensing fingers 240 against the web 244 from the primary roll, which web now covers the annular recesses 232 in the drive roll and precludes entry of the sensing fingers therein. The reserve roll is then rotatably mounted on the roll mounting elements 214, and the leading end of its web is extended between the sensing and the transfer fingers and forwardly around the lowermost ends of the transfer fingers. In this condition, the primary roll web blocks the sensing fingers from entering the drive roll recesses, and therefore the ends of the transfer fingers from moving to adjacent the nip between the feed rolls. Toweling from the primary roll may now be delivered from the cabinet, with webbing freely sliding over and moving past the sensing fingers 240.

The condition of the cabinet remains as shown in FIG. 7 until the primary roll is completely depleted and the end of its web moves from around the drive roll 228. When this occurs, or otherwise upon the absence of the web 244 from around the roll 228, the sensing fingers 240 are freed to move into the annular recesses 232. This results in downward movement of the bracket 236 by gravity to move the lower ends of the transfer fingers 242 into the annular recesses 230 in the idler roll 226 to adjacent the nip between the feed rolls to cause the end of the reserve roll webbing 246 to be introduced into the nip. In consequence, paper feed now occurs by withdrawing the web from the reserve roll. Thus, transfer of feed from the primary to from the reserve roll occurs only upon exhaustion of the primary roll, and is independent of the tension of the web 244 between the primary roll and the feed rolls. If desired, the dispensing cabinet may advantageously be equipped with a resettable indexing mechanism of the type shown in FIGS. 5 and 6 and heretofore described.

Figure 9:
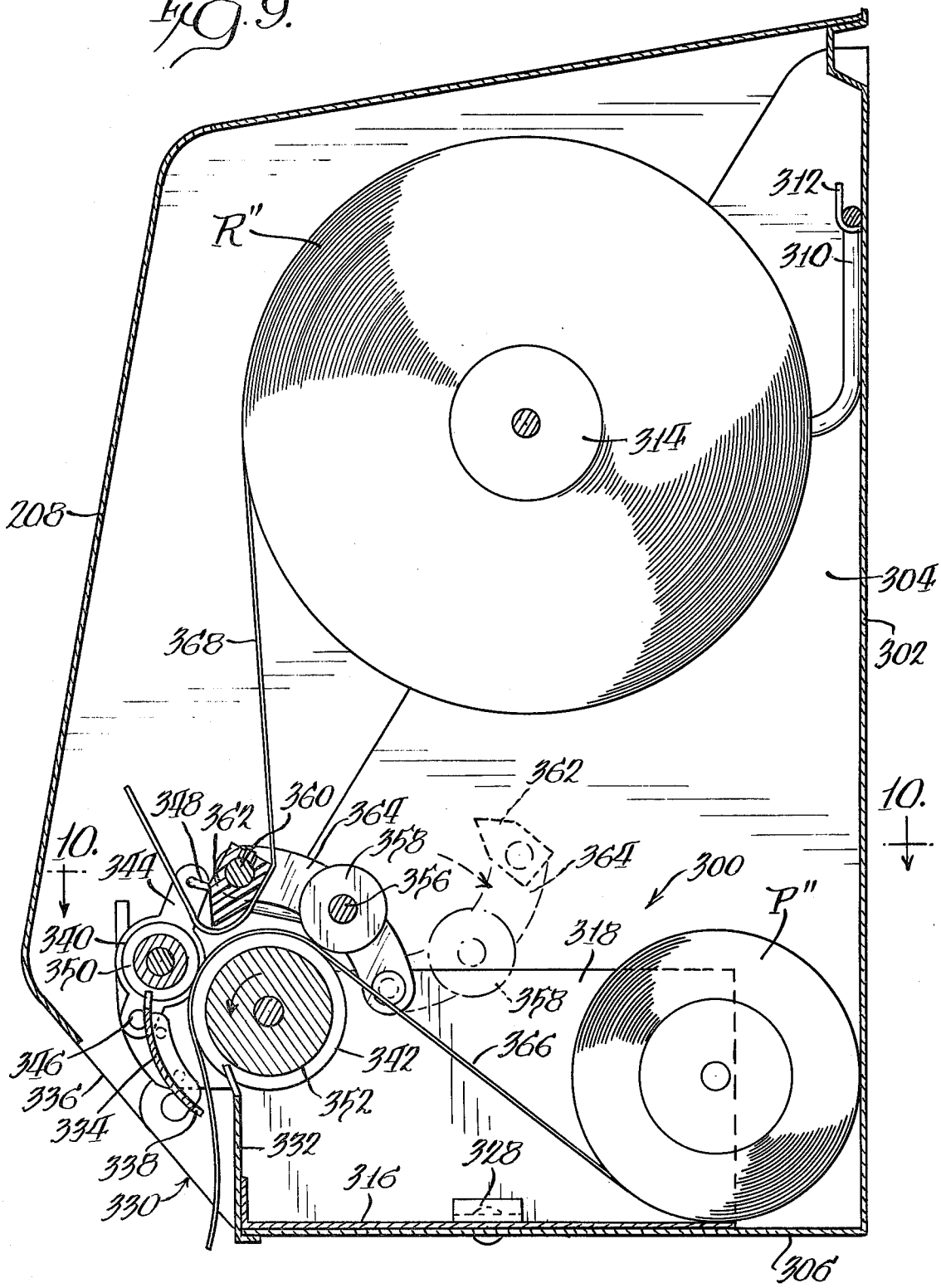
FIG. 9 is a cross-sectional elevation view of a dispensing cabinet having a removable towel transfer mechanism configured in accordance with a third embodiment of the invention, showing primary and reserve rolls of toweling in the cabinet with toweling from the primary roll being delivered therefrom, and showing the transfer mechanism positioned to transfer feed of toweling from the primary roll to from the reserve roll upon exhaustion of the primary roll.
Figure 10:
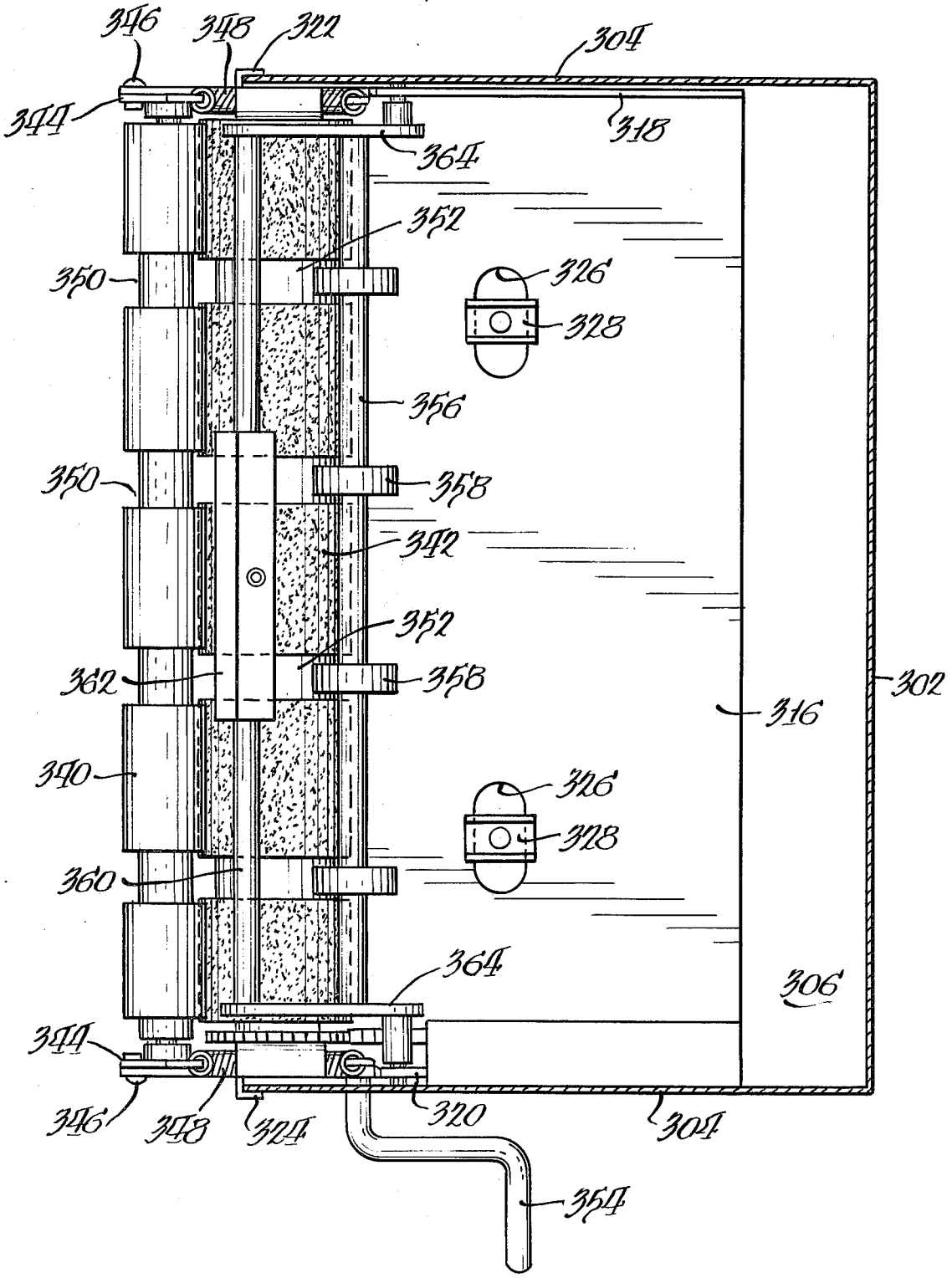
FIG. 10 is a top plan view of the dispensing cabinet taken substantially along the lines 10—10 of FIG. 9, illustrating the transfer mechanism and means for releasably securing the transfer mechanism in the cabinet.

Referring to FIGS. 9 and 10 of the drawings, there is shown a dispensing cabinet having a removable paper feed and transfer mechanism module, indicated generally at 300, in accordance with a further embodiment of the invention. Similar to the dispensing cabinet of FIGS. 1–4, the cabinet is provided with a back wall 302, side walls 304, a base 306 and a cover 308 pivotally mounted to the remaining cabinet structure for movement between positions either closing or exposing the interior of the cabinet. The cabinet also has stations for accommodating primary P″ and reserve R″ rolls of paper toweling, the primary roll station being provided in a lower portion of the cabinet. The reserve roll station is established in an upper portion of the cabinet by a bent wire element 310 rotatably supported on the back wall by hanger clips 312, and having roll mounting elements 314 configured to be received within and rotatably support opposite ends of the roll core of the reserve paper roll. Although the mounting roll elements are shown as circular, it is understood that, if desired, they may specially be configured to accommodate in the cabinet only rolls of paper toweling having complementary configured core ends.

Unlike the other embodiments of the invention, in this case the paper feed and transfer mechanisms are incorporated in the removable module 300, which includes as a support means therefor a U-shaped member having a base 316 and side walls 318 and 320 extending upwardly therefrom. The module is positionable within the cabinet with the base 316 thereof resting on the base 306 of the cabinet, and with forward lip portions 322 and 324 of the module side walls surrounding forward edges of the cabinet side walls 304. The module base is provided with a pair of elongate openings 326 for receiving therethrough a pair of twist-locks 328 which rotatably are mounted on the cabinet base, and which when rotated to lie along the lengths of the openings free the module for removal from or insertion into the cabinet. With the twist-locks rotated to be crosswise of the openings and across the surface of the module base as shown, the module is securely locked in the cabinet. Thus, by the expedient of the easily manipulable twist-locks, the module readily may be mounted in or removed from the cabinet with very little effort, whereby the module conveniently is serviceable outside of the cabinet or readily is replaceable with another module which, perhaps, may be of another variety or offer different features of operation.

The channel or passage through which toweling is delivered from the cabinet is indicated generally at 330, and is provided between an upright wall 332 and a curved plate 334 of the module, and through an opening 336 in the lower forward edge of the cover. A lower edge 338 of the plate is formed with paper cutting serrations or teeth, whereby paper delivered from the cabinet through the opening 326 may be severed by pulling.

The paper feed mechanism for delivering or dispensing toweling from the cabinet includes a pressure or idler roll 340 and a drive roll 342. The drive roll is journaled in and between the side walls of the module, and the idler roll is journaled in and between a pair of arms 344 which rotatably are connected by pins 346 at lower ends thereof with the module side walls, and which are urged by springs 348 at upper ends thereof in a direction to move the idler roll against the drive roll. The rolls are longitudinally juxtaposed to define a nip therebetween, the drive roll has rubber or other suitable friction material thereon for cooperating with the pressure roll in the feed of paper, and the pressure roll may be of any suitable material, such as wood. The pressure roll has a plurality of spaced annular recesses 350 formed therealong in the surface thereof concentrically therewith, and the drive roll has a like number of spaced annular recesses 352 formed therealong concentrically therewith and aligned with the recesses 230 of the pressure roll. The annular recesses on the drive roll cooperate with a feed transfer mechanism in the transfer of feed of toweling from the primary roll to from the reserve roll, as will be described. The drive roll is provided with an operating handle 354 and a one way clutch (not shown), whereby the roll may manually be rotated only in a direction for dispensing toweling from the cabinet.

The transfer mechanism for transferring feed of toweling from the primary roll P″ to from the reserve roll R″ is comprised of a shaft 356 having longitudinally therealong a plurality of rotatable paper towel sensing wheels 358, and a shaft 360 having securely mounted thereon a towel transfer means 362 generally in the shape of an elongated wedge. The shafts are fastened at opposite ends thereof to and between a pair of curved arms 364, which rotatably are journaled at lower ends thereof within the module side walls for movement of the towel sensing wheels and transfer wedge toward and away from the idler and drive rolls. The sensing wheels 358 are of like number with the annular recesses 352 in the drive roll, and have a width and spacing so that upon movement thereof toward the rolls the wheels enter associated annular recesses in the drive roll and a lower pointed or tapered end of the transfer wedge 362 moves to closely adjacent the nip between the rolls.

With the cabinet in the condition illustrated in FIG. 9, a webbing 366 from the primary roll extends in a run around the drive roll 342 and through the nip between the rolls for being delivered exterior of the cabinet, and the forward end of a webbing 368 from the reserve roll is extended under, around and forwardly of the transfer wedge for automatically being introduced into the feed mechanism upon exhaustion of the primary roll. To obtain this condition with an initially empty cabinet, the bracket 310 is rotated rearwardly and upwardly. This opens the primary roll station within the cabinet, so that a roll of toweling may be positioned therein and the forward end of the web thereof extended around the drive roll 342, through the nip between the feed rolls, and through the delivery channel 330 to exterior of the cabinet. The arms 364 are then rotated forwardly and downward to rest the web sensing wheels 358 on the web 366 from the primary roll, which web now covers the annular recesses 352 in the drive roll and precludes entry of the sensing wheels therein. The reserve roll is then rotatably mounted on the roll mounting elements 314, and the leading end of its web is extended under, around and forwardly of the transfer wedge 362. In this condition, the primary roll web blocks the sensing wheels from entering the drive roll recesses, and therefore the end of the transfer wedge from moving to adjacent the nip between the feed rolls. Toweling from the primary roll may now be delivered from the cabinet by operation of the crank 354.

The condition of the cabinet remains as shown in FIG. 9 until the primary roll is completely depleted and the end of its web moves from around the drive roll 342. When this occurs, or otherwise upon the absence of the web 366 from around the roll 342, the sensing wheels 358 are freed to move by gravity or otherwise into the annular recesses 352. This results in downward movement of the tapered end of the transfer wedge 362 to adjacent the nip between the feed rolls to cause the end of the reserve roll webbing 368 to be introduced into the nip. In consequence, paper feed now occurs by withdrawing the web from the reserve roll. Thus, transfer of feed from the primary to from the reserve roll occurs only upon exhaustion of the primary roll, and is independent of the tension of the web 366 between the primary roll and the feed rolls. If desired, the dispensing cabinet may advantageously be equipped with a resettable indexing mechanism for dispensing predetermined lengths of toweling.

The invention thus provides dispensing cabinets and transfer mechanisms of simple, economical and reliable construction, for sequentially dispensing toweling from primary and then from reserve rolls thereof. The transfer mechanisms switch feed of the rolls from the primary to from the reserve rolls only upon absolute exhaustion of the primary rolls or upon a break in the webs thereof, whereby any waste of toweling is avoided. Further, as the transfer function is responsive only to the ends of the primary roll webs being sensed, there can be no false or unreliable transfer of roll feed as occurs with conventional, web tension sensing systems.

While particular embodiments of the invention have been described in detail, other modifications and various embodiments thereof may be devised by one skilled in the art without departing from the spirit and the scope of the invention, as defined by the claims.

What is claimed is:

1. In a dispenser for sequentially dispensing sheet material from first and second supplies thereof, a feed mechanism for receiving material from either of said supplies and for dispensing said material, and means for sensing the presence of said first supply material at said feed mechanism when feeding said first supply material and for transferring said second supply material to said feed mechanism upon sensing the absence of said first supply material at said feed mechanism, said feed mechanism including a pair of parallel and engaging feed rolls at least one of which is rotatably driven to dispenser material, said material from said first supply extending around at least a portion of one of said rolls and between said rolls when said material is being fed, said sensing and transferring means including means for sensing the presence of said first supply material around said one of said rolls, and means for transferring said second supply material to between said rolls in response to said sensing means sensing the absence of said first supply material from around said one of said rolls.

2. In a dispenser as set forth in claim 1, said means for transferring including a transfer roll normally spaced from said feed rolls when said rolls are dispensing said first supply material, said transfer roll receiving said material from said second supply between said transfer roll and said feed rolls, said transfer roll being mounted for movement to between said feed rolls to deliver said second supply material thereto to begin feeding thereof in response to said sensing means sensing the absence of said first supply material from around said one of said feed rolls.

3. In a dispenser as set forth in claim 2, said one of said feed rolls having at least one annular slot formed in the surface thereof concentric therewith, said material from said first supply covering said slot along at least a portion of the surface of said roll when said material is being fed, said sensing means sensing whether said slot is covered or uncovered along said portion of said surface, said transfer means being responsive to said sensing means sensing that said slot is uncovered to deliver said second supply material to said feed rolls.

4. In a dispenser for sequentially dispensing sheet material from first and second supplies thereof, a feed mechanism for receiving material from either of said supplies and for dispensing said material, and means for sensing the presence of said first supply material at said feed mechanism when feeding said first supply material and for transferring said second supply material to said feed mechanism upon sensing the absence of said first supply material at said feed mechanism, said feed mechanism including a pair of parallel and engaging feed rolls at least one of which is rotatably driven to dispense material, said material from said first supply extending around at least a portion of one of said rolls and between said rolls when said material is being fed, said sensing and transferring means including means for sensing the presence of said first supply material around said one of said rolls, and means for transferring said second supply material to between said rolls in response to said sensing means sensing the absence of said first supply material from around said one of said rolls, said means for transferring including a transfer roll normally spaced from said feed rolls when said rolls are dispensing said first supply material, said transfer roll receiving said material from said second supply between said transfer roll and said feed rolls, said transfer roll being mounted for movement to between said feed rolls to deliver said second supply material thereto to begin feeding thereof in response to said sensing means sensing the absence of said first supply material from around said one of said feed rolls, said one of said feed rolls having at least one annular slot formed in the surface thereof concentric therewith, said material from said first supply covering said slot along at least a portion of the surface of said roll when said material is being fed, said sensing means sensing whether said slot is covered or uncovered along said portion of said surface, and transfer means being responsive to said sensing means sensing that said slot is uncovered to deliver said second supply material to said feed rolls, said sensing means including a sensing member slidingly engaging said first supply material over said slot when said material is being fed and being mounted for movement into said slot in the absence of said first supply material from thereover, said sensing member bing positioned between said transfer roll and said feed rolls when said first material is being fed and blocking movement of said transfer roll to between said feed rolls, said sensing member entering said slot upon passage of a tail end of said first supply material therepast to free said transfer roll for movement to between said feed rolls to deliver said second supply material thereto to thereby initiate feed of said second supply material.

5. In a dispenser as set forth in claim 4, said transfer roll urging said second supply material against said sensing member when said first supply material is being fed.

6. In a dispenser as set forth in claim 1, said feed mechanism including a pair of parallel and engaging feed rolls at least one of which is rotatably driven to dispense material, said material from said first supply extending around at least a portion of one of said rolls and between said rolls when said material is being fed, said sensing and transferring means sensing the presence of said first supply material around said one of said rolls and transferring said second supply material to between said rolls in response to the absence of said first supply material from around said one of said rolls.

7. In a dispenser for sequentially dispensing sheet material from first and second supplies thereof, a feed mechanism for receiving material from either of said supplies and for dispensing said material, and means for sensing the presence of said first supply material at said feed mechanism when feeding said first supply material and for transferring said second supply material to said feed mechanism upon sensing the absence of said first supply material at said feed mechanism, said feed mechanism including a pair of parallel and engaging feed rolls at least one of which is rotatably driven to dispense material, said material from said first supply extending around at least a portion of one of said rolls and between said rolls when said material is being fed, said sensing and transferring means sensing the presence of said first supply material around said one of said rolls and transferring said second supply material to between said rolls in response to the absence of said first supply material from around said one of said rolls, said one of said rolls having at least one annular slot formed in the surface thereof concentric therewith, said first supply material covering said slot along at least a portion of the surface of said roll when said material is being fed, said sensing and transferring means sensing whether said slot is covered or uncovered by said first supply material along said portion of said surface and delivering said second supply material to between said feed rolls in response to said slot being uncovered.

8. In a dispenser as set forth in claim 7, said sensing and transferring means including a material sensing element and a material transfer element mounted in fixed spaced relationship for constrained simultaneous movement, and means mounting said elements for movement between a position remote from said rolls and a position entering said material sensing element within said slot and said material transfer element between said rolls, said material sensing element slidingly engaging said first supply material over said slot when said first supply material is being fed and being blocked thereby from entry into said slot and said transfer element receiving said second supply material between said transfer element and said feed rolls, said sensing element entering said slot upon passage of the end of said first supply material from thereover whereby said transfer element moves said second supply material to between said feed rolls to deliver said second supply material thereto to begin feeding thereof.

9. In a device for dispensing sheet material from rolls thereof, a cabinet; sheet material feed means within said cabinet having a pair of feed rolls rotatably engaging and forming a material feed nip, said cabinet having a station for a primary roll of said sheet material from which said material extends in a run around at least a portion of one of said feed rolls and into said nip, said cabinet also having a station for a reserve roll of said sheet material from which said material extends in a run to a point adjacent said nip, and transfer means for introducing said reserve roll material from its position adjacent said nip into said nip in response to movement of said primary roll material from around said one feed roll.

10. In a device as set forth in claim 9, said transfer means including means for sensing the presence of said primary roll material around said one feed roll when said material is being fed, and a transfer roll extending generally parallel to said feed rolls, said reserve roll material extending in said run to between said transfer roll and said nip, said transfer roll being mounted to move to adjacent said nip to introduce said reserve roll material into said nip in response to said sensing means sensing the absence of said primary roll material from around said one feed roll.

11. In a device for dispensing sheet material from rolls thereof, a cabinet; sheet material feed means within said cabinet having a pair of feed rolls rotatably engaging and forming a material feed nip, said cabinet having a station for a primary roll of said sheet material from which said material extends in a run around at least a portion of one of said feed rolls and into said nip, said cabinet also having a station for a reserve roll of said sheet material from which said material extends in a run to a point adjacent said nip, and transfer means for introducing said reserve roll material from its position adjacent said nip into said nip in response to movement of said primary roll material from around said one feed roll, said transfer means including means for sensing the presence of said primary roll material around said one feed roll when said material is being fed, and a transfer roll extending generally parallel to said feed rolls, said reserve roll material extending in said run to between said transfer roll and said nip, said transfer roll being mounted to move to adjacent said nip to introduce said reserve roll material into said nip in response to said sensing means sensing the absence of said primary roll material from around said one feed roll, said one feed roll having at least one annular slot formed in the surface thereof concentric therewith, said primary roll material extending around said one feed roll covering at least a portion of said slot when said material is being fed, said sensing means including a material feeler engaging the primary roll material over said covered portion of said slot for being blocked from entry therein by said material, said material feeler mounted for movement into said slot in the absence of said primary roll material thereover, said transfer roll being responsive to said material feeler entering said slot to introduce said reserve roll material into said nip.

12. In a device as set forth in claim 11, said transfer roll urging said reserve roll material against said material feeler and said material feeler being positioned between said transfer roll and said feed rolls when said primary roll material is being fed, whereby upon passage of an end of said primary roll material from around said one feed roll said material feeler enters said slot and frees said transfer roll for movement introducing said reserve roll material into said nip.

13. In a device for dispensing sheet material from rolls thereof, a cabinet; sheet material feed means within said cabinet having a pair of feed rolls rotatably engaging and forming a material feed nip, said cabinet having a station for a primary roll of said sheet material from which said material extends in a run around at least a portion of one of said feed rolls and into said nip, said cabinet also having a station for a reserve roll of said sheet material from which said material extends in a run to a point adjacent said nip, and transfer means for introducing said reserve roll material from its position adjacent said nip into said nip in response to movement of said primary roll material from around said one feed roll, said one of said rolls having at least one annular slot formed in the surface thereof concentric therewith, said primary roll material extending around said one roll covering said slot along at least a portion of the surface of said roll when said primary roll material is being fed, said transfer means sensing whether said slot is covered or uncovered along said portion of said surface and introducing said reserve roll material into said nip in response to said slot being uncovered.

14. In a device as set forth in claim 13, said transfer means including a material sensing element and a material transfer element mounted in fixed spaced relationship for constrained simultaneous movement, and means mounting said elements for movement between a position remote from said rolls and a position entering said sensing element within said slot and said transfer element to adjacent said nip, said sensing element slidingly engaging said primary roll material over said slot when said primary roll material is being fed and being blocked from entry therein by said material and said reserve roll material extending in said run to between said transfer element and said nip, said sensing element entering said slot upon passage of the end of said primary roll material from thereover whereby said transfer element moves said reserve roll material to adjacent said nip to introduce said material therein.

15. In a device for dispensing sheet material from rolls thereof, a cabinet; sheet material feed means within said cabinet having a pair of feed rolls rotatably engaging and forming a material feed nip, said cabinet having a station for a primary roll of said sheet material from which said material extends in a run around at least a portion of one of said feed rolls and into said nip, said cabinet also having a station for a reserve roll of said sheet material from which said material extends in a run to a point adjacent said nip, and transfer means for introducing said reserve roll material from its position adjacent said nip into said nip in response to movement of said primary roll material from around said one feed roll, and including means for detachably mounting said sheet material feed means and transfer means in said cabinet for removal of the same as a single unit therefrom.

16. In a device for dispensing sheet material from rolls thereof, a cabinet; sheet material feed means within said cabinet having a pair of feed rolls rotatably engaging and forming a material feed nip, said cabinet having a station for a primary roll of said sheet material from which said material extends in a run around at least a portion of one of said feed rolls and into said nip, said cabinet also having a station for a reserve roll of said sheet material from which said material extends in a run to a point adjacent said nip, and transfer means for introducing said reserve roll material from its position adjacent said nip into said nip in response to movement of said primary roll material from around said one feed roll, and including a frame positionable in and removable from said cabinet, said sheet material feed means and transfer means being mounted on said frame, and locking means for detachably securing said frame to said cabinet.

17. In a dispenser for paper from rolls, a cabinet having a dispensing opening; paper feed means for delivering paper from the interior of said cabinet through said dispensing opening, said cabinet having a station for a primary paper roll from which the paper web extends in a run to feeding engagement with said feed means, said cabinet also having a station for a reserve paper roll from which the paper web extends in a run to adjacent said feed means, and transfer means for urging the reserve paper web from its position adjacent said feed means into operative engagement with said feed means in response to movement of a tail end of said primary roll web out of feeding engagement with said feed means.

18. In a dispenser as set forth in claim 17, said feed means including a pair of feed rolls operatively engaging and forming a paper feed nip, said primary paper web extending in said run to around at least a portion of one of said feed rolls and through said nip, said transfer means including means for sensing movement of a tail end of said primary paper web from around said one feed roll and a transfer roll extending generally parallel to said feed rolls and mounted for urging said reserve paper web into said nip in response to said sensing means sensing movement of said tail end of said primary roll web from around said one feed roll.

19. In a dispenser for paper from rolls, a cabinet having a dispensing opening; paper feed means for delivering paper from the interior of said cabinet through said dispensing opening, said cabinet having a station for a primary paper roll from which the paper web extends in a run to feeding engagement with said feed means, said cabinet also having a station for a reserve paper roll from which the paper web extends in a run to adjacent said feed means, and transfer means for urging the reserve paper web from its position adjacent said feed means into operative engagement with said feed means in response to movement of a tail end of said primary roll web out of feeding engagement with said feed means, said feed means including a pair of feed rolls operatively engaging and forming a paper feed nip, said primary paper web extending in said run to around at least a portion of one of said feed rolls and through said nip, said transfer means including means for sensing movement of a tail end of said primary paper web from around said one feed roll and a transfer roll extending generally parallel to said feed rolls and mounted for urging said reserve paper web into said nip in response to said sensing means sensing movement of said tail end of said primary roll web from around said one feed roll, said one feed roll forming at least one annular opening therealong and concentric therewith, said primary roll web extending over and covering at least a portion of said opening when said primary roll web is being fed, said sensing means including a web feeler engaging said primary roll web over said opening during feeding thereof and mounted for movement into said opening upon passage of said tail end of said primary roll web therepast, said transfer roll being responsive to movement of said web feeler into said opening to urge said reserve roll web into said nip.

20. In a dispenser as set forth in claim 19, said transfer roll urging said reserve roll web against said web feeler and said web feeler blocking movement of said transfer roll toward said feed rolls during feed of said primary roll web, said web feeler upon entering said opening then freeing said transfer roll for movement toward said feed rolls to introduce said reserve roll web into said nip, whereupon said feed means delivers paper from said reserve roll exterior of said cabinet through said dispensing opening.

21. In a dispenser as set forth in claim 20, said feed rolls being manually rotatable to deliver paper from said cabinet, indexing means limiting rotation of at least one of said rolls to a predetermined number of revolutions for delivering a predetermined length of a paper web through said dispensing opening, and means for manually resetting said indexing means for dispensing additional predetermined lengths of said paper web.

22. In a dispenser for paper from rolls, a cabinet having a dispensing opening; paper feed means for delivering paper from the interior of said cabinet through said dispensing opening, said cabinet having a station for a primary paper roll from which the paper web extends in a run to feeding engagement with said feed means, said cabinet also having a station for a reserve paper roll from which the paper web extends in a run to adjacent said feed means, and transfer means for urging the reserve paper web from its position adjacent said feed means into operative engagement with said feed means in response to movement of a tail end of said primary roll web out of feeding engagement with said feed means, said feed means including a pair of feed rolls operatively engaging and forming a paper feed nip, said primary paper web extending in said run to around at least a portion of one of said rolls and through said nip, said transfer means including means for sensing movement of a tail end of said primary paper web from around said one feed roll and for urging said reserve paper web into said nip in response thereto.

23. In a dispenser as set forth in claim 22, said one feed roll forming at least one annular opening therealong and concentric therewith, said primary paper web extending over and covering at least a portion of said opening when said primary paper web is being fed, said transfer means including a frame having a web sensing element and a web transfer element, and means for mounting said frame for movement between positions with said elements remote from said feed rolls and a position with said sensing element within said opening and said transfer element adjacent said nip, said sensing element slidingly engaging said primary paper web over said opening and being blocked thereby from entry into said opening when said primary paper web is being fed and said reserve paper web extending in said run to between said transfer element and said nip, said sensing element entering said opening upon passage of said tail end of said primary paper web therepast whereby said transfer element moves said indexing means for dispensing additional predetermined lengths of said paper web.

24. In a device as set forth in claim 17, means for detachably mounting said paper feed means and transfer means in said cabinet for removal of the same as a single unit therefrom.

25. In a device as set forth in claim 17, a frame positionable in and removable from said cabinet, said paper feed means and transfer means being mounted on said frame, and locking means for detachably securing said frame to said cabinet.

* * * * *